United States Patent [19]

Beckmann

[11] 4,200,338

[45] Apr. 29, 1980

[54] MINERAL MINING INSTALLATION

[75] Inventor: Klaus Beckmann, Lunen, Fed. Rep. of Germany

[73] Assignee: Gewerkschaft Eisenhutte Westfalia, Lunen, Fed. Rep. of Germany

[21] Appl. No.: 959,942

[22] Filed: Nov. 13, 1978

[30] Foreign Application Priority Data

Nov. 15, 1977 [DE] Fed. Rep. of Germany ..... 2751016

[51] Int. Cl.[2] ..... E21C 27/32

[52] U.S. Cl. ..... 299/43; 299/34

[58] Field of Search ..... 299/43, 42, 33, 34

[56] References Cited

U.S. PATENT DOCUMENTS 4,045,089 8/1977 Hauschopp et al. ..... 299/43

FOREIGN PATENT DOCUMENTS 377525 6/1973 U.S.S.R. ..... 299/34

546713 2/1977 U.S.S.R. ..... 299/34

*Primary Examiner*—William F. Pate, III

*Attorney, Agent, or Firm*—Thompson, Birch, Gauthier & Samuels

[57] ABSTRACT

A mineral mining installation comprises a conveyor, a guide arranged on the face side of the conveyor, a roof support assembly arranged on the goaf side of the conveyor, and apparatus for controlling the cutting horizon of a plough movable along the guide. The control apparatus has hydraulic ram means for pivoting the guide relative to the conveyor, and guide rod means for transferring the control forces to the roof support assembly.

17 Claims, 6 Drawing Figures

MINERAL MINING INSTALLATION

BACKGROUND OF THE INVENTION

This invention relates to a mineral mining installation, and in particular to apparatus for controlling the position of a mineral mining machine, such as a plough, movable along a guide provided at the face-side of a conveyor.

One known form of such control apparatus utilises hydraulic advance rams and guide rod assemblies for advancing the conveyor (and the machine guide which is fixed thereto) towards the mineral face. Each guide rod assembly is associated with a respective mine roof support unit of a walking mine roof support assembly positioned along the goaf side of the conveyor. Each hydraulic advance ram is guided by its associated guide rod assembly and is backed by the respective roof support unit. Each guide rod assembly is pivotable in a plane perpendicular to that of the mineral face, and each is coupled to the conveyor by means of a respective hydraulic control ram. These hydraulic control rams are operable to tilt the conveyor (and hence the machine guide) thereby to control the cutting horizon of the mineral mining machine. Typical forms of known control apparatus are described in DT-OS No. 2,319,910, DT-OS No. 2,534,325 and DT-OS No. 2,101,454.

This type of control apparatus has proved quite successful in practice. Unfortunately, it suffers from the disadvantage that the conveyor has to take up all the forces exerted by the control rams and the advance rams. Consequently, the conveyor has to be considerably stronger than it would have to be merely to carry out its conveying function.

The aim of the invention is to provide control apparatus for a mineral mining installation which does not suffer from the disadvantage of the known type of control apparatus.

SUMMARY OF THE INVENTION

The present invention provides a mineral mining installation comprising a conveyor, a guide arranged on one side of the conveyor, and apparatus for controlling the position of a mineral mining machine movable along the guide, the control apparatus being such as to pivot the guide relative to the conveyor, thereby to control the cutting horizon of the mineral mining machine.

Advantageously, the conveyor is constituted by a plurality of conveyor sections, and the guide is constituted by a plurality of guide sections, each guide section being associated with a respective conveyor section, and each guide section being provided with respective control apparatus for pivoting that guide section relative to the corresponding conveyor section.

Preferably, each control apparatus comprises guide rod means, one end of which is pivotally connected to the respective guide section, and a hydraulic control ram pivotally connected to the respective guide section and to an intermediate portion of the guide rod means, the hydraulic control ram being operable to pivot that guide section about the pivotal connection between that guide section and the associated guide rod means. With this form of control apparatus the conveyor does not take up any of the control forces, or any of the operating forces acting on the guide. Thus, the conveyor can be of lightweight construction. Another advantage is that the conveyor sections hardly, if at all, participate in the pivotal movement of the corresponding guide sections.

In use, said one side of the conveyor is the mine face side. In this case, it is advantageous for the hydraulic control rams to be provided on the mine face side of the conveyor, for example, within the guide itself. This has the advantage of not taking up valuable space on the goaf side of the conveyor.

The guide rod means may be constituted by a pair of parallel guide rods, an intermediate member connected thereto, and a guide rod extension connected to the intermediate member and extending therefrom in the opposite direction to that in which the guide rods extend, the free end of the guide rod extension constituting said one end, and the intermediate member constituting said intermediate portion. Advantageously, the guide defines a pair of ducts for containing the two runs of an endless chain for driving the mineral mining machine. In this case, each guide section amy be provided with a chamber for accommodating the respective hydraulic control ram, the chamber being positioned between the chain ducts and the corresponding conveyor section.

Said one end of the guide rod means of each guide section may be connected to that guide section at a point more remote from the conveyor than the point at which the respective hydraulic control ram is connected to that guide section. The cylinder of the hydraulic control ram of each guide section may be pivotally connected to a bracket extending from the base of that guide section and towards the respective conveyor section. Advantageously, the intermediate member of each guide rod means is connected to a pivot pin associated with the piston rod of the hydraulic control ram associated therewith by means of a pair of parallel upstanding links. Preferably, the intermediate member of each guide rod means is constituted by a rectangular, annular coupling element, the hydraulic control ram of that guide rod means passing through the coupling element.

Conveniently, each guide rod means passes between the upper and lower runs of the respective conveyor section, and each of the conveyor sections is of lightweight construction.

Preferably, each guide section is constituted by a slide plate whose end edge is adapted to bear against the mine floor, an inclined ramp covering the pair of chain ducts, and a spacer between the ducts, the pivotal connection between said one end of the guide rod means and the guide section being provided in the region where the spacer meets the inclined ramp.

Advantageously, each guide section and its respective conveyor section are provided with slidably engageable cover plates which close the top of the chamber housing the respective hydraulic control ram, the cover plates being such that the top of said chamber is closed over the entire pivotal range of that guide section relative to that conveyor section.

The installation may further comprise a plurality of roof support units arranged on the opposite side of the conveyor to the guide, a respective roof support unit being associated with each of the conveyor sections. Advantageously, the other end of the guide rod means of each control apparatus is slidably connected to the floor sill of the associated roof support unit. In this case, each guide rod means may also constitute thrust rod means for advancing the associated guide and conveyor sections.

The invention also provides apparatus for controlling the cutting horizon of a mineral mining machine movable along a guide provided at the face side of a conveyor, the apparatus comprising means for the pivoting the guide relative to the conveyor.

BRIEF DESCRIPTION OF DRAWINGS

A mineral mining installation incorporating control apparatus constructed in accordance with the invention will now be described, by way of example, with reference to the accompanying drawings, in which.

DESCRIPTION OF PREFERRED EMBODIMENT

Figure 1:
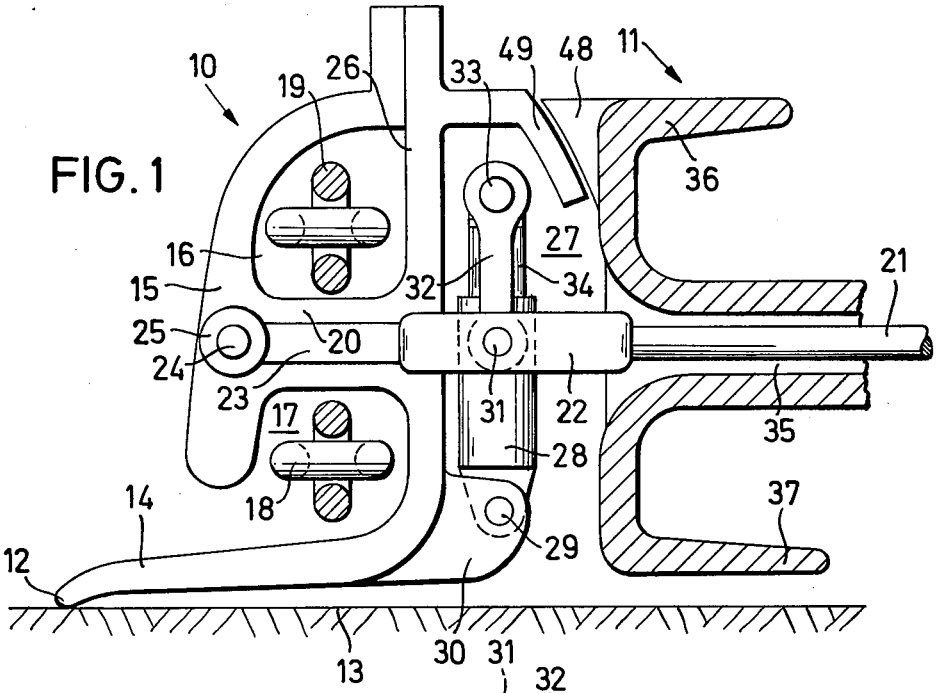
FIG. 1 is a part-sectional elevation of the installation showing the control apparatus in a first operating position.

Referring to the drawings, FIG. 1 shows a mineral mining installation having a plough guide 10 provided at the face side of a scraper-chain conveyor 11. The plough guide 10 is constituted by a plurality of guide sections, each of which is associated with a corresponding conveyor section. Each guide section has a slide plate 14 whose end edge 12 rests on the floor 13 of the mine working. Each guide section also has an inclined ramp 15 which defines ducts 16 and 17 for the upper and lower runs 19 and 18 respectively of an endless plough drive chain. The lower run 18 of the drive chain is connected to a plough (not shown) whereby the plough can be driven back and forth along the guide 10, the upper run 18 constituting the return run. The two ducts 16 and 17 are separated by a spacing element 20. The slide plate 14 bears, in use, against the mineral face, and so constitutes means for limiting the depth of cut of the plough.

Figure 4:
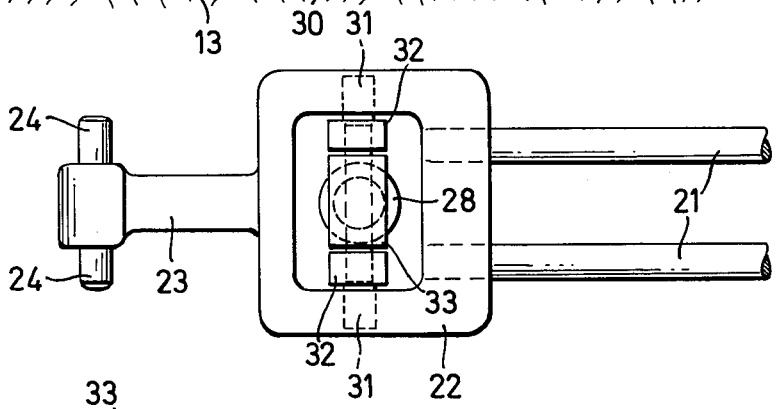
FIG. 4 is a plan view of the control apparatus of FIGS. 1 to 3.
Figure 5:
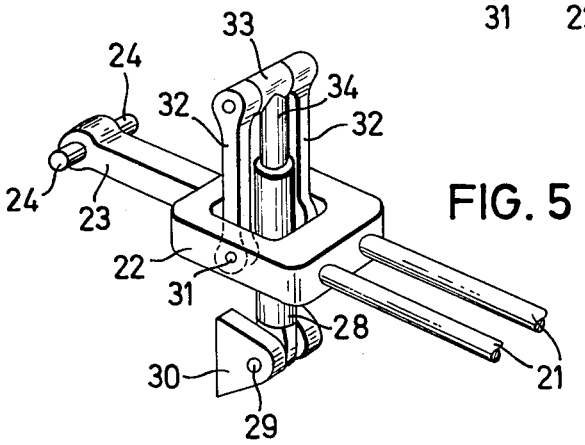
FIG. 5 is a perspective view of the control apparatus of FIGS. 1 to 4.

Each of the guide sections is provided with control apparatus for controlling the position of the plough as it moves along the guide 10. Each control apparatus is associated with a respective roof support unit of a walking roof support assembly, and each has a pair of parallel guide rods 21 whose front ends are connected by a head piece 22. As can best be seen in FIGS. 4 and 5, each of the head pieces 22 is of rectangular, annual configuration. Each head piece 22 is provided with a coupling member 23 which is pivotally connected at 25, by means of transverse, horizontal pivot pins 24 to that portion of the corresponding guide section where the spacing element 20 meets the ramp 15. Thus, the guide rods 21 can pivot in a vertical plane perpendicular to the mineral face.

Each guide section is provided with a rear wall 26 which defines the rear face of the ducts 16 and 17, a space 27 being formed between this rear wall and the adjacent section of the conveyor 11. This space 27 accommodates a hydraulic control ram 28 whose cylinder is pivotally mounted at 29, on a bifurcated bracket 30 extending rearwardly from the slide plate 14. The piston rod 34 of the ram 28 is connected to a crossbar 33, the two ends of which are rotatably mounted in the upper ends of a pair of links 32, the lower ends of which are pivotally connected, at 31, to the head piece 22.

Figure 6:
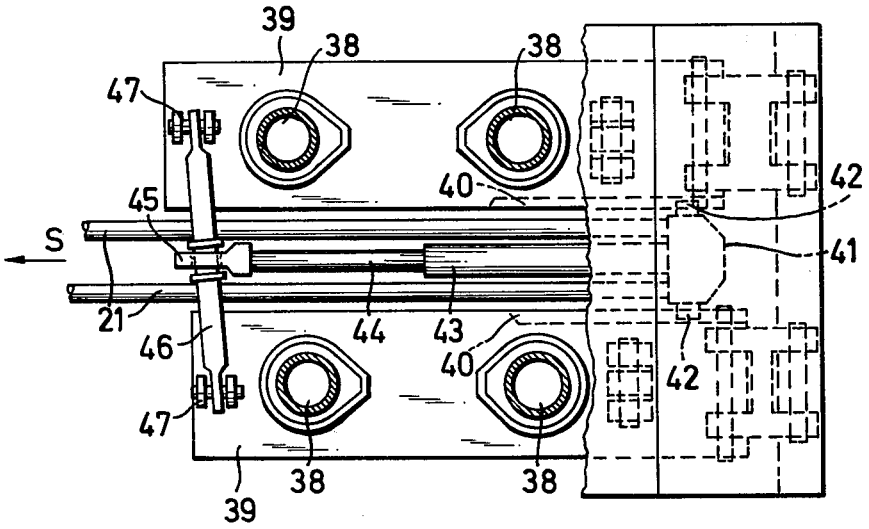
FIG. 6 is a plan view of a roof support unit to be used with the installation of FIGS. 1 to 3.

The guide rods 21 associated with each guide section extend through a box-like gap 35 formed between the upper and lower runs 36 and 37 respectively of the conveyor 11. The rear ends of the guide rods 21 are connected to a transverse yoke 41 (see FIG. 6). Pins 42 are provided at the ends of the yoke 41, each of these pins being a sliding fit within a respective guide slot 40, the guide slots being formed in the facing side edges of a pair of floor plates 39 which form the floor sill of the roof support unit associated with that guide section. A roof shield (not shown) is supported above the floor sill by means of hydraulic props 38. The cylinder of a hydraulic advance ram 43 is attached to the yoke 41, its piston rod 44 being connected, by means of a link 45, to a transverse rod 46 which is coupled by links 47 to the two floor plates 39. Thus, the guide rods 21 can slide, relative to the floor plates 39, in the direction of advance S.

Figure 2:
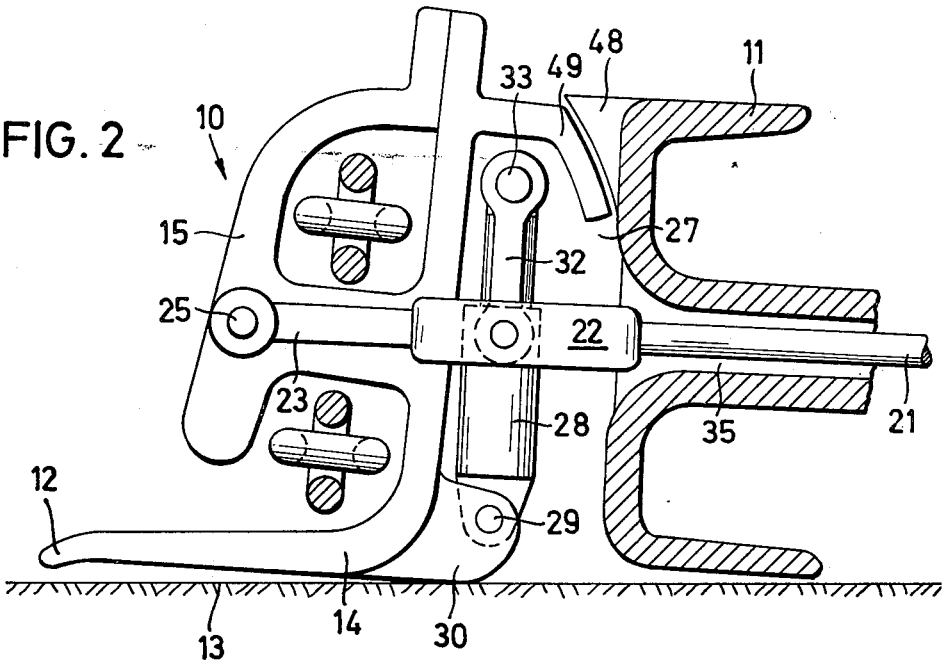
FIG. 2 is a part-sectional elevation of the installation showing the control apparatus in a second operating position.
Figure 3:
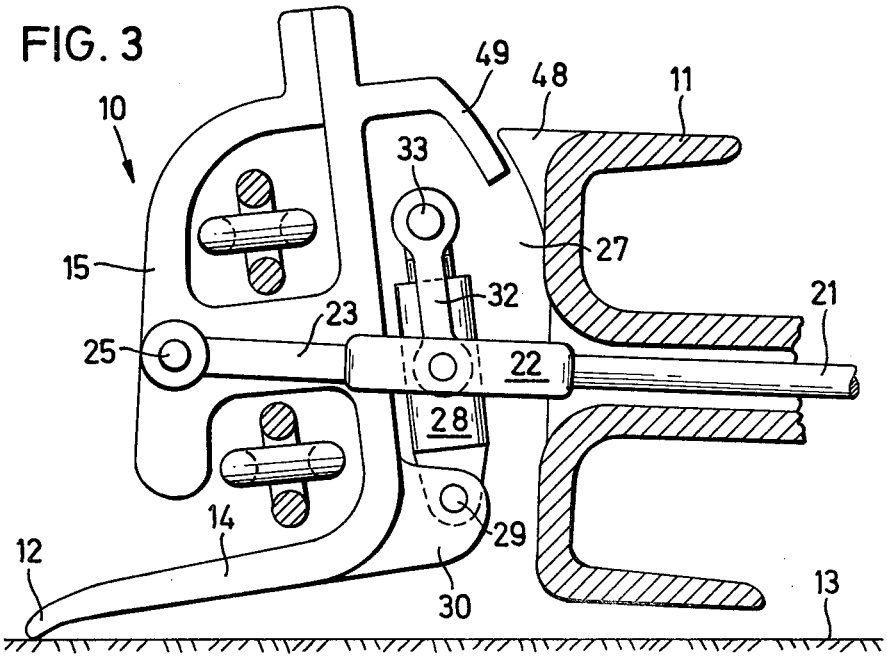
FIG. 3 is a part-sectional elevation of the installation showing the control apparatus in a third operating position.

FIG. 1 shows the control apparatus in its normal position with the guide section being supported on the mine floor 13 by means of the end edge 12 of its slide plate 14. By extending the hydraulic control rams 28, the guide 10 is tilted into the position shown in FIG. 2. Here the end edges 12 of the slide plates 14 are lifted clear of the mine floor 13, and the guide 10 rests on the mine floor by means of its brackets 30. In this position (the "climbing" position), the plough will make a cut at an elevated horizon. Similarly, if the hydraulic advance rams 28 are retracted, the guide 10 is tilted into the position shown in FIG. 3. In this position (the "dipping " position), the plough will cut into the floor 13 and hence make a cut at a lowered horizon.

Thus, the cutting horizon of the plough can be controlled by means of the hydraulic control rams 28, the guide sections being pivoted by their associated rams 28 about the pivot points 25, the conveyor 11 participating hardly at all in the pivotal movement. As a given guide section pivots in this manner, its guide rods 21 are supported, at their rear ends, by the engagement between the pins 42 and the guide slots 40 in the side edges of the floor plates 39. The forces applied by the control rams 28 act, therefore, directly on the guide sections, and are transferred by the guide rods 21 to the roof support units. Consequently, these control forces are not applied to the conveyor 11 so that its upper and lower runs 36 and 37 respectively do not take up any of the loads resulting from these control forces.

In order to protect the spaces 27 against the ingress of coal dust, earth and small rocks, co-operating covering elements 48 and 49 are secured respectively to the rear face of the guide 10 and to the side wall of the upper run 36 of the conveyor 11. By arranging these covering elements 48 and 49 as curved plates which are a sliding fit, even fine coal dust can be excluded from the spaces 27 in all three control positions.

The guide 10 and the conveyor 11 are advanced towards the mine face with the aid of the hydraulic advance rams 43. The rams 43 act on the guide 10 via the guide rods 21 which thus also serve as thrust rods, the roof support units forming abutments for the advance of their corresponding guide and conveyor sections. Once the guide 10 and the conveyor 11 have been advanced, the props 38 are retracted, and the roof support units are advanced, in a follow-up sequence, by retracting the rams 43. During their advance, the guide rods 21 serve to guide the roof support units.

I claim:

1. A mineral mining installation comprising: a conveyor constituted by a plurality of conveyor sections; a guide arranged on one side of the conveyor and constituted by a plurality of guide sections, each guide section having a corresponding conveyor section associated therewith; and a control apparatus associated with each respective guide section and corresponding conveyor section, said control apparatus having guide rod means, one end of which is pivotally connected to the respective guide section, and a hydraulic control ram pivotally connected to the respective guide section and to an intermediate portion of the guide rod means, the hydraulic control ram being operable to pivot that guide section relative to the corresponding conveyor section about the pivotal connection between that guide section and the associated guide rod means, thereby to control the cutting horizon of a mineral mining machine moving along said guide.

2. A mineral mining installation according to claim 1, wherein each guide rod means is constituted by a pair of parallel guide rods, an intermediate member connected thereto, and a guide rod extension connected to the intermediate member and extending therefrom in the opposite direction to that in which the guide rods extend, the free end of the guide rod extension constituting said one end, and the intermediate member constituting said intermediate portion.

3. A mineral mining installation according to claim 2, wherein the guide defines a pair of ducts for containing the two runs of an endless chain for driving the mineral mining machine.

4. A mineral mining installation according to claim 3, wherein each guide section is provided with a chamber for accommodating the respective hydraulic control ram, the chamber being positioned between the chain ducts and the corresponding conveyor section.

5. A mineral mining installation according to claim 1 wherein said one end of the guide rod means of each guide section is connected to that guide section at a point more remote from the conveyor than the point at which the respective hydraulic control ram is connected to that guide section.

6. A mineral mining installation according to claim 1, wherein the cylinder of the hydraulic control ram of each guide section is pivotally connected to a bracket extending from the base of that guide section and towards the respective conveyor section.

7. A mineral mining installation according to claim 2, wherein the intermediate member of each guide rod means is connected to a pivot pin associated with the piston rod of the hydraulic control ram associated therewith by means of a pair of parallel upstanding links.

8. A mineral mining installation according to claim 2, wherein the intermediate member of each guide rod means is constituted by a rectangular, annular coupling element, the hydraulic control ram of that guide rod means passing through the coupling element.

9. A mineral mining installation according to claim 1, wherein each guide rod means passes between the upper and lower runs of the respective conveyor section.

10. A mineral mining installation according to claim 9, wherein each of the conveyor sections is of lightweight construction.

11. A mineral mining installation according to claim 3, wherein each guide section is constituted by a slide plate whose end edge is adapted to bear against the mine floor, an inclined ramp covering the pair of chain ducts, and a spacer between the ducts, the pivotal connection between said one end of the guide rod means and the guide section being provided in the region where the spacer meets the inclined ramp.

12. A mineral mining installation according to claim 4, wherein each guide section and its respective conveyor section are provided with slidably engageable cover plates which close the top of the chamber housing the respective hydraulic control ram, the cover plates being such that the top of said chamber is closed over the entire pivotal range of that guide section relative to that conveyor section.

13. A mineral mining installation according to claim 1, further comprising a plurality of roof support units arranged on the opposite side of the conveyor to the guide, a respective roof support unit being associated with each of the conveyor sections.

14. A mineral mining installations according to claim 13, wherein the other end of the guide rod means of each control apparatus is slidably connected to the floor sill of the associated roof support unit.

15. A mineral mining installation according to claim 14, wherein each guide rod means also constitutes thrust rod means for advancing the associated guide and conveyor sections.

16. In a mineral mining installation comprising a conveyor constituted by a plurality of conveyor sections, a guide arranged on the face side of the conveyor and constituted by a plurality of guide sections, each guide section having a corresponding conveyor section associated therewith, a roof support assembly arranged on the goaf side of the conveyor, the improvement comprising a control apparatus associated with each respective guide section and corresponding conveyor section, said control apparatus having guide rod means, one end of which is pivotally connected to a respective guide section and the other end of which is connected to the roof support assembly, and a hydraulic control ram pivotally connected to the respective guide section and to an intermediate portion of the guide rod means, the hydraulic control ram being operable to pivot that guide section relative to the corresponding conveyor section about the pivotal connection between that guide section and the associated guide rod means, thereby to control the cutting horizon of a mineral mining machine moving along said guide, the connection between said guide rod means and the roof support assembly thereby resulting in the control forces being transferred to the roof support assembly.

17. A mineral mining installation comprising a conveyor channel section, a guide section arranged on one side of the conveyor channel section, and apparatus for controlling the position of a mineral mining machine movable along the guide section, the control apparatus being arranged to pivot the guide section relative to the conveyor channel section thereby to control the cutting horizon of the mineral mining machine, wherein the control apparatus comprises guide rod means, one end of which is pivotally connected to the guide section, and a hydraulic control ram pivotally connected to the guide section and to an intermediate portion of the guide rod means, the hydraulic control ram being operable to pivot the guide section about the pivotal connection between the guide section and the guide rod means.

* * * * *